US006468101B2

(12) United States Patent
Suzuki

(10) Patent No.: US 6,468,101 B2
(45) Date of Patent: Oct. 22, 2002

(54) CARD CONNECTOR

(75) Inventor: Mitsuo Suzuki, Tokyo (JP)

(73) Assignee: KEL Corporation, Tokyo (JP)

( * ) Notice: Subject to any disclaimer, the term of this patent is extended or adjusted under 35 U.S.C. 154(b) by 0 days.

(21) Appl. No.: 09/966,154

(22) Filed: Sep. 27, 2001

(65) Prior Publication Data

US 2002/0045375 A1 Apr. 18, 2002

(30) Foreign Application Priority Data

Oct. 11, 2000 (JP) ..... 2000-310135

(51) Int. Cl.[7] ..... H01K 13/62; H01K 24/00
(52) U.S. Cl. ..... 439/326; 439/630
(58) Field of Search ..... 439/326, 331, 439/630

(56) References Cited

U.S. PATENT DOCUMENTS 4,602,351 A * 7/1986 Shimamura et al. ..... 235/441
5,320,552 A 6/1994 Reichardt ..... 439/331
5,603,629 A * 2/1997 DeFrasne et al. ..... 439/326
5,813,878 A * 9/1998 Kuwata et al. ..... 439/326
5,933,328 A * 8/1999 Wallace et al. ..... 257/678
5,984,707 A * 11/1999 Kuwata ..... 439/326
6,062,889 A * 5/2000 Hyland et al. ..... 200/51.12
6,149,466 A * 11/2000 Bricaud et al. ..... 235/441
6,174,188 B1 * 1/2001 Martucci ..... 439/326
6,210,193 B1 * 4/2001 Ito et al. ..... 439/326
6,210,233 B1 * 4/2001 Hoolhorst et al. ..... 439/326
6,220,882 B1 * 4/2001 Simmel et al. ..... 439/326
6,227,893 B1 * 5/2001 Kaneko ..... 439/326
6,241,545 B1 * 6/2001 Bricaud et al. ..... 439/326
6,319,036 B1 * 11/2001 Zheng et al. ..... 439/326
6,334,786 B1 * 1/2002 Lee ..... 439/326

FOREIGN PATENT DOCUMENTS

WO WO17806 3/2000

* cited by examiner

*Primary Examiner*—Tho D. Ta
*Assistant Examiner*—Edwin A. Leéon
(74) *Attorney, Agent, or Firm*—Robert W J Usher

(57) ABSTRACT

A card connector 1, which is constructed with a main body 11, a flap member 21, a plurality of first contacts 31 and a plurality of second contacts 32, comprises a first connector section 10 and a second connector section 20. The first connector section 10 allows removable insertion of a first card-like memory module 51 through a insertion opening 12 into a slot-like receiving part provided at the lower part of the main body 11 for electrical connection through the first contacts 31, which are aligned and retained in the receiving part. The second connector section 20 allows removable installation of a second card-like memory module 52 for electrical connection through the second contacts 32, which are aligned and retained on the main body above the receiving part, with the flap member 21 being mounted on the upper part of the main body 11 pivotally to be opened and closed for installation of the second card-like memory module 52.

7 Claims, 8 Drawing Sheets

CARD CONNECTOR

RELATED APPLICATIONS

This application claims the priority of Japanese Patent Application No. 2000-310135 filed on Oct. 11, 2000, which is incorporated herein by reference.

FIELD OF THE INVENTION

The present invention relates to a card connector which enables removable attachment of a card-like memory module to a circuit board for information transfer between the memory module and information processing circuits provided on the board.

BACKGROUND OF THE INVENTION

Recent development in information technology has achieved miniaturization, mass and high-speed storage, low-power consumption and function diversification of card-like memory modules. As a result, various types of card-like memory modules (hereinafter referred to as "memory cards" or "cards") are now standardized for use in cellular telephone sets and information processing and image processing equipment. Examples of such memory cards are SIM Card, SD Card, Memory Stick and Smart Media (all are registered trademarks).

Nowadays, efforts are being made to develop a product which makes use of various types of memory cards to take advantage of functions or features offered by individual memory cards. Such products are a cellular phone which allows attachment of multiple cards and an information processing device which accepts various types of memory cards.

At present, standards specifying memory cards are different for each type, so various types of card connectors are used to removably mount various types of memory cards to circuit boards. In this circumstance, to make a product which enables use of multiple types of memory cards, the circuit board of the product must be equipped with multiple types of card connectors that are designed for these specific types of memory cards. This condition presents the following problems, which will increase production cost. The surface areas required on the circuit board for the mounting of the connectors must increase, and the number of assembly steps must also increase correspondingly to the number of the connectors being required.

SUMMARY OF THE INVENTION

It is an object of the present invention to provide a card connector which allows insertion of a plurality of memory cards.

It is also an object of the present invention to provide a card connector which requires no extra surface area for mounting and which allows insertion of a plurality of memory cards.

The present invention provides a card connector which comprises a main body, a flap member, a plurality of first contacts and a plurality of second contacts. The main body has a receiving part, which a first card-like memory module is inserted into and removed from through an insertion opening. The flap member is mounted on the upper part of the main body pivotally so as to be opened and closed with respect to the main body, and the flap member engages and retains a second card-like memory module in closed condition and maintains the second card-like memory module parallel to the upper surface of the main body and above the receiving part. Each first contact, which is retained in the main body, comprises a first contact portion at one end (for example, the contact portion 31*a* described in the following embodiment), which extends out of the lower surface of the receiving part into the receiving part, and a first mounting portion at the other end (for example, the tail portion 31*b* described in the following embodiment), which extends to and comes out of the lower surface of the main body. Each second contact, which is retained in the main body, comprises a second contact portion at one end (for example, the contact portion 32*a* described in the following embodiment), which extends upward out of the main body at a location above the receiving part, and a second mounting portion at the other end (for example, the tail portion 32*b* described in the following embodiment), which extends to and comes out of the lower surface of the main body. In this card connector, when the first card-like memory module is inserted into the receiving part, the terminals of the first card-like memory module come into contact with the first contact portions in the receiving part, so that information transfer can be executed between the first card-like memory module and a plated printed circuit provided on a circuit board, to which circuit the first mounting portions are connected. Furthermore, when the flap member is closed to install the second card-like memory module on the upper part of the main body, the terminals of the second card-like memory module come into contact with the second contact portions, so that information transfer can be executed between the second card-like memory module and the plated printed circuit, to which the second mounting portions are connected.

This connector has a first connector section, which comprises the receiving part of the main body and the first contacts, and a second connector section, which is positioned above the receiving part of the main body, i.e., above the first connector section, and which comprises the flap member and the second contacts extending upward above the receiving part. If the first card-like memory module is inserted in the first connector section, and the second card-like memory module, which is set in the flap member, is installed in the second connector section, then information transfer can be executed between each card-like memory module and the circuit of the circuit board, on which the card connector is mounted. As the first connector section and the second connector section are stacked one on the other in a one-piece body of the card connector, the installation area required for one card connector can be used effectively for simultaneous use of two removable card-like memory modules. This arrangement of the card connector does not increase number of parts and number of assembly steps much, so the present invention can provide such card connectors and circuit boards at a relatively low production-cost.

In the card connector, it is preferable that the first mounting portions of the first contacts and the second mounting portions of the second contacts be arranged on sides of the main body which sides are faced in two directions that meet at right angles. In this arrangement, for example, the first contacts and the second contacts are placed to extend in directions perpendicular to each other, and the ends of the first and second contacts to be used for mounting the card connector are bent simply toward the circuit board as the first and second mounting portions. The mounting portions can be placed on two mutually perpendicular sides of the main body where the contacts extend, or on three mutually perpendicular sides of the main body by arranging either the first contacts or the second contacts on both the sides of the main body in one direction, or on the four mutually perpendicular sides around the main body by arranging both the first contacts and the second contacts on both the sides of the main body in the two directions. In this way, the peripheral sides of the main body can be used effectively to arrange the mounting portions of the contacts. As a result, the card connector, which allows simultaneous use of two card-like memory modules, can be designed to require a relatively small area for installation.

According to another aspect of the present invention, a card connector, which comprises a main body, a flap member, a plurality of first contacts and a plurality of second contacts, has the following features. The main body has a receiving part with an insertion opening, where a first card-like memory module is inserted and removed. The flap member is mounted pivotally on the part of the main body that extends laterally away from the receiving part, so the flap member can be opened and closed with respect to the main body. The flap member, after receiving a second card-like memory module, is closed to install and retain the second card-like memory module laterally next to the first card-like memory module, which is installed in the receiving part. Each first contact, which is retained in the main body, comprises a first contact portion at one end (for example, the contact portion 36*a* described in the following embodiment), which extends out of the lower surface of the receiving part into the receiving part, and a first mounting portion at the other end (for example, the tail portion 36*b* described in the following embodiment), which extends to and comes out of the lower surface of the main body. Each second contact, which is retained in the main body, comprises a second contact portion at one end (for example, the contact portion 37*a* described in the following embodiment), which extends upward out of the part of the main body that extends laterally away from the receiving part, and a second mounting portion at the other end (for example, the tail portion 37*b* described in the following embodiment), which extends to and comes out of the lower surface of the main body. In this card connector, when the first card-like memory module is inserted into the receiving part, the terminals of the first card-like memory module come into contact with the first contact portions, so that information transfer can be executed between the first card-like memory module and a plated printed circuit provided on a circuit board, to which the first mounting portions are connected. Also, when the flap member is closed to install the second card-like memory module, the terminals of the second card-like memory module come into contact with the second contact portions, so that information transfer can be executed between the second card-like memory module and the plated printed circuit, to which the second mounting portions are connected.

This connector also has a first connector section, which comprises the receiving part of the main body and the first contacts, and a second connector section, which comprises the part of the main body that extends laterally away from the receiving part of the first connector section, the flap member and the second contacts that extend upward from the part of the main body extending laterally away from the receiving part. If the first card-like memory module is inserted in the first connector section, and the second card-like memory module, which is set in the flap member, is installed in the second connector section, then information transfer can be executed between each card-like memory module and the circuit of the circuit board, on which the card connector is mounted. As the first connector section and the second connector section are arranged laterally next to each other in a one-piece body of the card connector, the installation height required for one card connector can be used effectively for simultaneous use of two removable card-like memory modules. This arrangement of the card connector does not increase number of parts and number of assembly steps much, so the present invention can provide such card connectors and circuit boards at a relatively low production-cost.

Further scope of applicability of the present invention will become apparent from the detailed description given hereinafter. However, it should -be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention and wherein.

DESCRIPTION OF THE PREFERRED EMBODIMENTS

Figure 1:
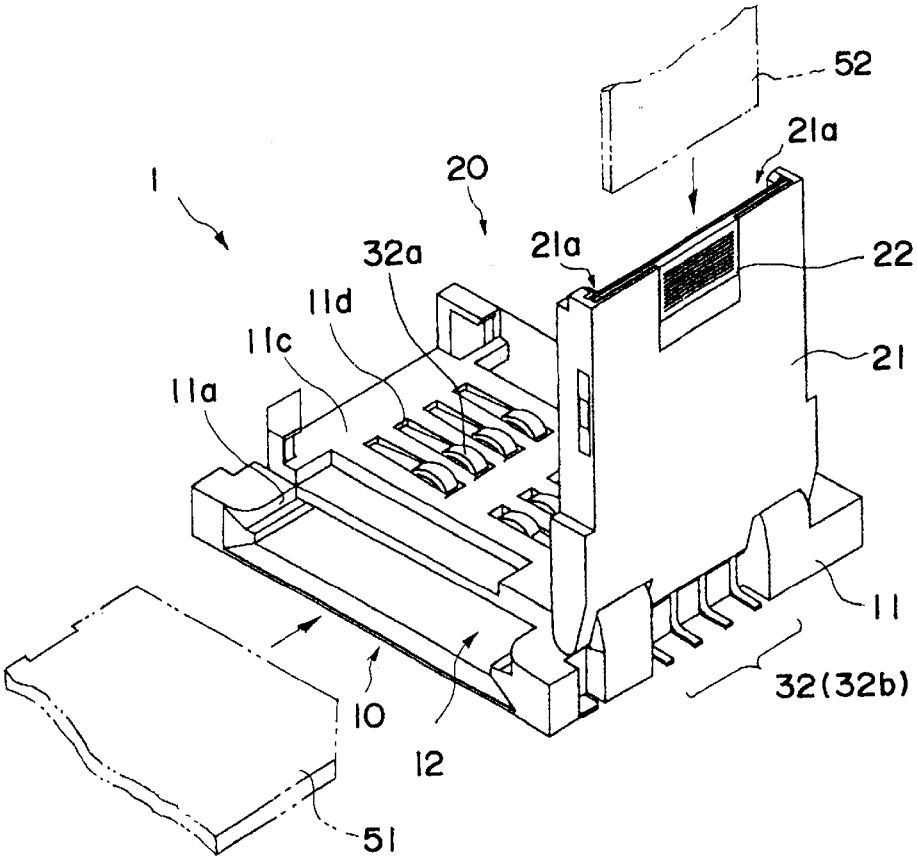
FIG. 1 is a perspective view of a card connector 1 as a preferred embodiment according to the present invention, in which view, a flap member located at the upper part of the connector is open.
Figure 2:
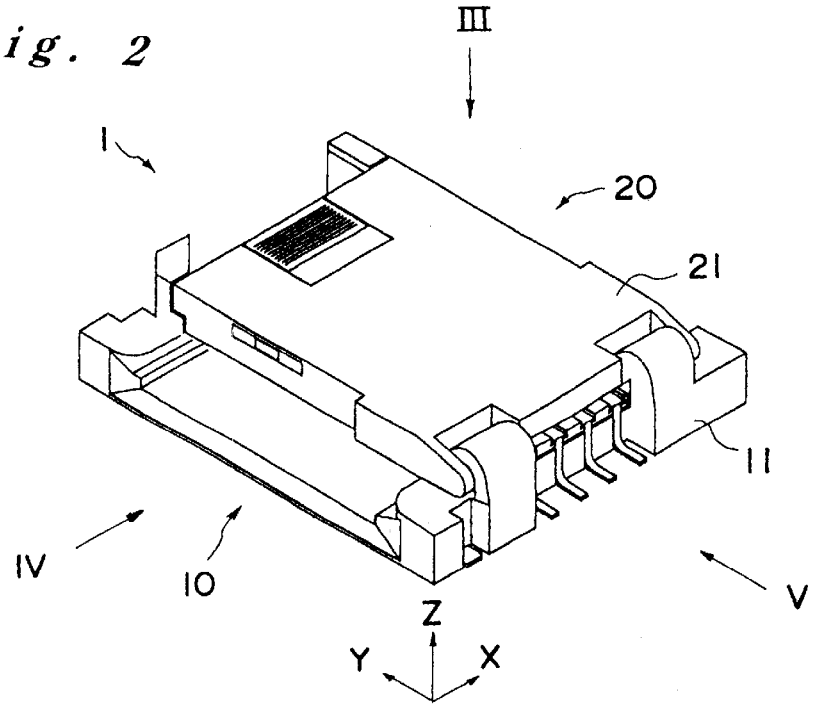
FIG. 2 is also a perspective view of the card connector 1, in which view, the flap member is closed.
Figure 8A:
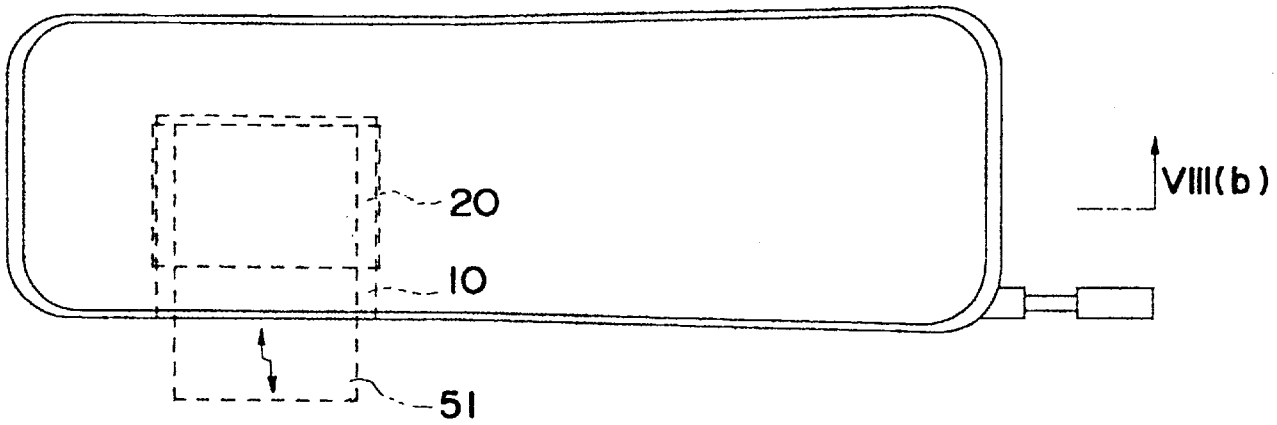
FIG. 8(*a*) and FIG. 8(*b*) are an illustration showing the condition of the card connector 1 being mounted on a circuit board which is provided in a cellular phone.
Figure 8B:
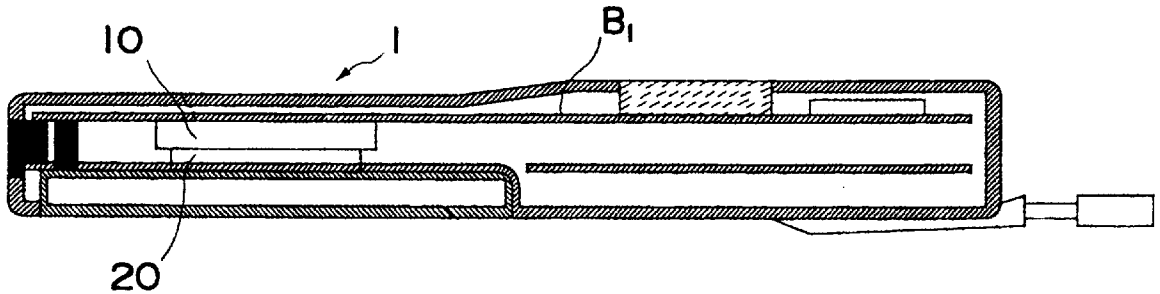

With reference to the drawings, preferred embodiments according to the present invention are described in detail. As a first embodiment, FIGS. 1 and 2 show a card connector 1 according to the present invention in perspective view while FIG. 8 shows the card connector 1 applied into a cellular phone as an example. In the following description, the directions along the X, Y and Z coordinate axes provided in FIG. 2 are referred to as "front and rear direction", "right and left direction" and "up and down direction" for ease of understanding.

The card connector 1, which is mounted on a printed circuit board $B_1$enables information transfer between two types of memory cards (card-like memory modules) 51 and 52, which are inserted in the connector, and a circuit provided on the printed circuit board $B_1$. The card connector 1 comprises a first connector section 10, which engages and disengages a first card 51, for example, SD Card (registered trademark), and a second connector section 20, which engages and disengages a second card 52, for example, SIM Card (registered trademark). The second connector section 20 is stacked over the first connector section 10 to form a one-body card connector.

The card connector 1 further comprises a main body 11, which functions as a common base for the first connector section 10 and the second connector section 20, and a flap member 21, which is mounted on the main body 11 and opened and closed pivotally as shown in FIG. 1 (showing the opened condition of the card connector 1) and in FIG. 2 (showing the closed condition). Furthermore, the card connector 1 comprises a plurality of first contacts 31, which are provided in the first connector section 10 for electrical connection between the first card 51 and the circuit board, and a plurality of second contacts 32, which are provided in the second connector section 20 for electrical connection between the second card 52 and the circuit board.

Figure 3:
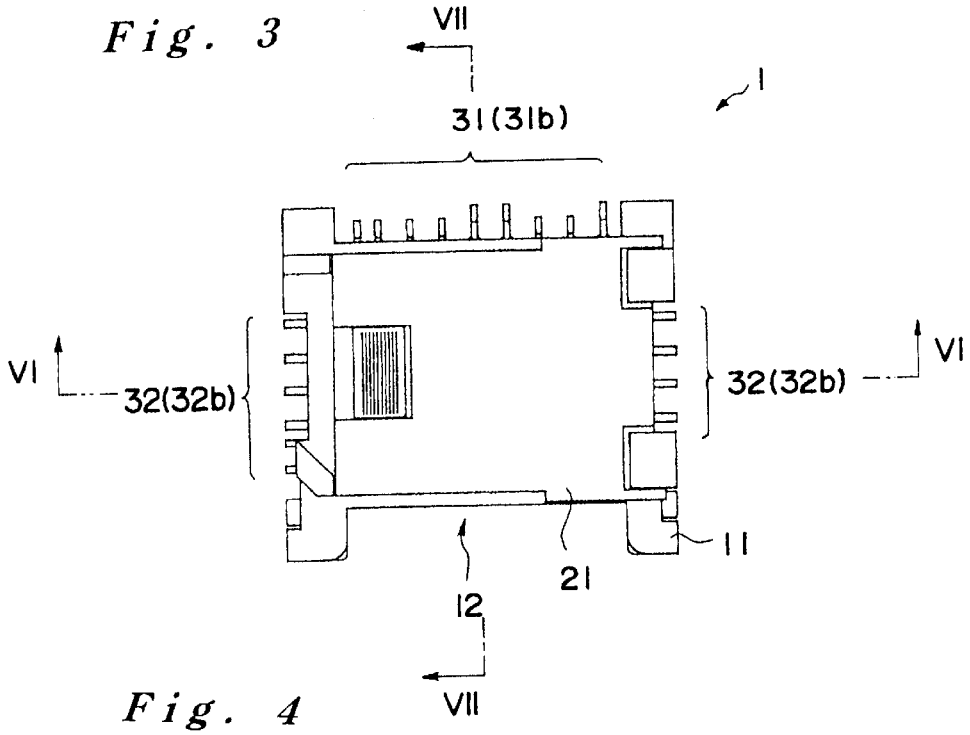
FIG. 3 is a plan view of the card connector 1, viewed in the direction indicated by arrow III in FIG. 2.
Figure 4:
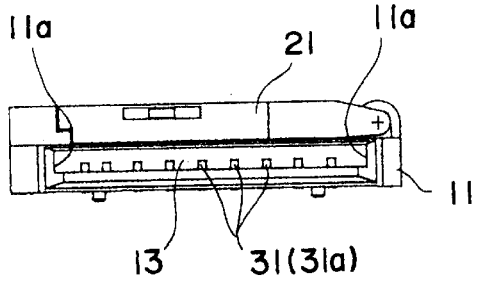
FIG. 4 is a front view of the card connector 1, viewed in the direction indicated by arrow IV in FIG. 2.
Figure 5:
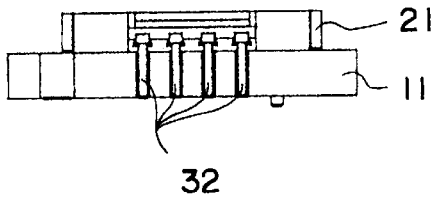
FIG. 5 is a side view of the card connector 1, viewed in the direction indicated by arrow V in FIG. 2.
Figure 6:
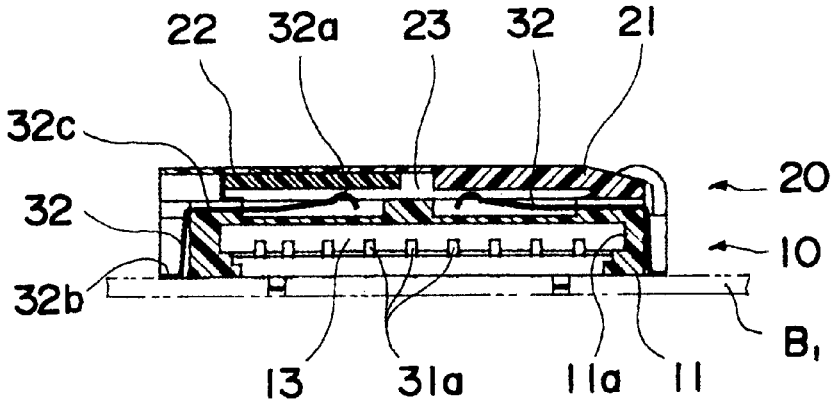
FIG. 6 is a sectional view of the card connector 1, taken along line VI—VI in FIG. 3.
Figure 7:
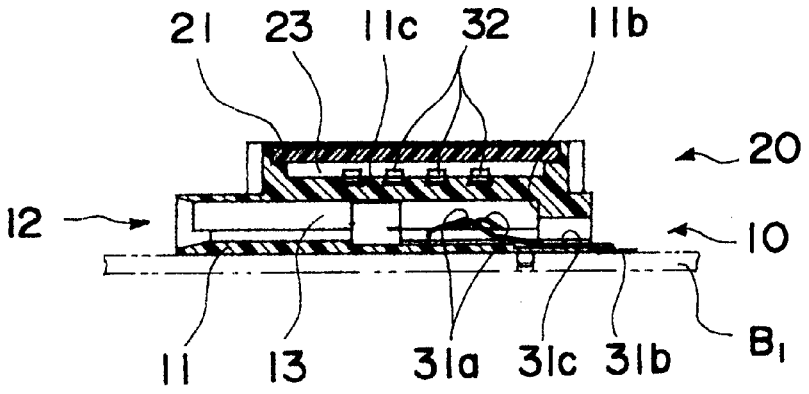
FIG. 7 is a sectional view of the card connector 1, taken along line VII—VII in FIG. 3.

A plan view of the card connector 1 in the direction indicated by arrow III in FIG. 2 is shown in FIG. 3, a front view in the direction indicated by arrow IV in FIG. 2 is shown in FIG. 4, and a right-side view in the direction indicated by arrow V in FIG. 2 is shown in FIG. 5. A sectional view of the card connector 1, taken along line VI—VI in FIG. 3, is shown in FIG. 6 while a sectional view taken along line VII—VII in FIG. 3 is shown in FIG. 7. With reference to these drawings, each part of the card connector 1 is described in the following paragraphs.

The main body 11 and the flap member 21 are formed of an electrically insulative resin, for example, polyphenylene sulfide (PPS resin) or a liquid-crystal polymer (LCP) by a well-known molding technique such as injection molding. The main body 11 has a slot-like receiving part 13 with an insertion opening 12 on the front, and it accommodates the first card 51. The receiving part 13 has guide portions Ha at the right and left edges thereof to guide the right and left sides of the first card 51 and a wall portion 11*b* to be hit by the inserted end of the first card 51. The wall portion 11*b* stops the insertion of the first card 51 and fixes the relative position of the first card 51. In this wall portion 11*b*, the first contacts 31 are press-fit from the outside and fixed as shown in the drawings.

FIG. 7 is a side view of the first contacts 31, showing their longer sides, and FIGS. 4 and 6 are front views of the same contacts, which views are perpendicular to the side view. As shown in these drawings, each first contact 31 is formed in a thin and long finger-like figure and bent in a plurality of steps, and each first contact 31 comprises a contact portion 31*a* at one end, a tail portion 31*b* at the other end and a retained portion 31*c* which is the part between the contact portion 31*a* and the tail portion 31*b*. The contact portion 31*a* comes into contact with a corresponding terminal of the first card 51, the tail portion 31*b* is soldered to a terminal provided in the circuit of the circuit board, and the retained portion 31*c* is to be press-fit and fixed in the main body 11. The first contacts 31 and the second contacts 32, which will be described later, are made of a metallic material that has high degrees of electrical conductivity and resiliency, for example, a copper alloy. They are die-punched and formed by a well-known press work, for example, fine blanking, and then surface-treated, if necessary, by nickel plating, gold plating, tin-alloy plating, etc.

These first contacts 31 are press-fit into slits which are provided at a predetermined pitch on the rear side of the main body 11, so that the retained portions 31*c* of the first contacts 31 are aligned and retained fixedly in the main body 11. In this condition, the contact portions 31*a* of the first contacts 31 extend upward in the receiving part 13 of the main body 11. When the first card 51 is inserted into the receiving part 13, the first contacts 31 undergo an elastic deformation. As a result, when the first card 51 has reached its engaged condition or position, a predetermined contact pressure is generated and kept between the contact portions 31*a* of the first contacts 31 and the corresponding terminals that are provided on the lower surface of the first card 51. The tail portions 31*b* of the first contacts 31 extending outward from the main body 11 are aligned parallel to and positioned a little lower than the lower surface of the main body 11. When the card connector 1 is assembled to the circuit board, the tail portions 31*b* are soldered to the corresponding terminals of the circuit provided on the circuit board.

When the first card 51 is inserted through the insertion opening 12 of the main body 11 in the first connector section 10, which is located at the lower part of the main body 11, the terminals provided on the lower surface of the first card 51 come into contact with the contact portions 31*a* of the first contacts 31 in the receiving part 13 of the main body 11. In this condition, information transfer can be executed between the first card 51 and the circuit of the circuit board through the first contacts 31.

The upper surface of the main body 11 is formed as a partition wall 11*c*, which functions to partition the receiving part 13. The second contacts 32 are provided on the partition wall 11*c*. Each of the second contacts 32 is also formed in a long finger-like figure in a similar way as the first contacts 31 and comprises a contact portion 32*a*, a tail portion 32*b* and a retained portion 32*c*. The contact portion 32*a* is located at one end of the second contact 32 and formed in an arc figure, and it comes into contact with a corresponding terminal provided on the second card 52. The tail portion 32*b* is located at the other end of the second contact 32, and it is soldered onto a corresponding terminal provided in the circuit of the circuit board. The retained portion 32*c* is the part between the contact portion 32*a* and the tail portion 32*b*, and it is press-fit and retained in the main body 11.

The second contacts 32 are press-fit into slits provided at a predetermined pitch on the right and left sides of the main body 11, so that the retained portions 32*c* are aligned and fixed in the main body 11. In this condition, the contact portions 32*a* of the second contacts 32 are positioned in window-like openings 11*d* that are provided in the partition wall 11*c* of the main body 11, with the contact portions 32*a* being raised above the upper surface of the partition wall 11*c*. As shown in FIG. 6, the second contacts 32 are fixed in a cantilever-like condition, so when the contact portions 32*a* are pressed downward, the second contacts 32 undergoes elastic deformation. The tail portions 32*b*, which extend outward from the main body 11, are arranged parallel to and a little lower than the lower surface of the main body 11. When the card connector 1 is mounted on the circuit board, the tail portions 32*b* are soldered to the corresponding terminals of the circuit provided on the circuit board.

The flap member 21 is mounted pivotally on the main body 11, so that the flap member 21 can be swung, i.e., opened and closed, in the Y-Z coordinate system. The flap member 21 has a recess in the lower side thereof, so that when the flap member 21 is closed, a retaining space 23 is provided between the lower surface of the flap member 21 and the upper surface of the partition wall 11*c*, as an accommodation for the second card 52. At the front and rear sides of the retaining space 23 of the flap member 21, guide grooves 21*a* are provided to slide the sides of the second card 52. Therefore, after the second card 52 is inserted along the guide grooves 21*a* into the flap member 21, when the flap member 21 is swung downward and closed, the second card 52 is accommodated in the retaining space 23.

While the second card 52, which is retained in the guide grooves 21*a*, is being swung downward together with the flap member 21 into the retaining space 23, the terminals of the second card 52, which are provided on the lower surface thereof, are brought into contact with the contact portions 32*a* of the second contacts 32, which protrude from the window-like openings 11*d* into the retaining space 23. Because the second contacts 32 are supported like cantilevers as mentioned above, thereafter as the flap member 21 is pressed downward further to set the second card 52 in the retaining space 23, a predetermined contact pressure is generated and kept between the contact portions 32*a* of the second contacts 32 and the terminals of the second card 52 because of the resiliency of the second contacts 32, which are deformed elastically.

The flap member 21 is provided with a slide lock 22, which can be slid in the direction parallel to the guide grooves 21*a*. After the flap member 21 is closed, the slide lock 22 is slid, so that one end of the slide lock 22 protrudes and engages the main body 11. As a result, the flap member 21 is locked in its closed condition. In summary, the second card 52 is set in the flap member 21, then the flap member 21 is closed, and then, the flap member 21 is locked by the slide lock 22. In this condition, the second card 52 is fixed in the retaining space 23 by the resiliency of the second contacts 32.

When the flap member 21 is closed, and the second card 52 is set in the retaining space 23 of the second connector section 20, which is provided on the main body 11, the terminals of the second card 52, which are provided on the lower surface thereof, are in contact with the contact portions 32*a* of the second contacts 32. In this condition, information transfer can be executed between the second card 52 and the circuit of the circuit board through the second contacts 32.

As described above, the card connector 1 according to the present invention comprises the first connector section 10 and the second connector section 20. This construction of the card connector 1 allows the installation area required for one card connector to be used effectively for simultaneous use of two removable memory cards. In the card connector, the first contacts 31 and the second contacts 32 are placed perpendicularly in plan view, and the tail portions of the first contacts 31 and the second contacts 32 are positioned around three sides of the main body 11. This arrangement is also effective in minimizing the installation area of the card connector on the circuit board. Furthermore, the partition wall 11*c* between the first connector section 10 and the second connector section 20 functions as a common insulative member, so the whole of the card connector can be made in a relatively small and light-weight device and be manufactured at a relatively low production cost. Because the card connector 1 includes two connector units in a one-piece body, not only the cost for manufacturing the card connector but also the cost for managing the parts and the number of the assembly steps required for the production of the card connector can be kept to a relatively small level. As a result, by incorporating the card connector 1, it is possible to produce, at a relatively low cost, multi-functional electronics products such as cellular phones and information processing devices in small and light-weight bodies.

For example, the card connector 1 may be incorporated in a cellular phone as shown in FIG. 8. In this design, the second card 52, in which basic functions selected for the model of the cellular phone are memorized, is installed in the cellular phone before the cellular phone is shipped from a factory. Later, if a need arises, the first card 51, in which supplementary functions selected for the need are memorized, is inserted through an opening provided on a side of the phone to add the preferred functions. In this case, a plurality of first cards, each card enabling different functions, can be used with the cellular phone. In this way, a multi-functional product can be realized as a small light-weight device at a relatively low cost.

Now, another preferred embodiment of card connector according to the present invention is described with reference to FIG. 9 to FIG. 14. This card connector 2 is mounted on a printed circuit board $B_2$ in the same way as in the case of the card connector 1 and enables information transfer between the two types of memory cards 51 and 52 and a circuit provided on the printed circuit board $B_2$. The card connector 2 comprises a first connector section 15, which engages and disengages the first card 51, and a second connector section 25, which engages and disengages the second card 52. The first connector section 15 and the second connector section 20 are arranged laterally next to each other to form a one-body card connector.

Figure 9:
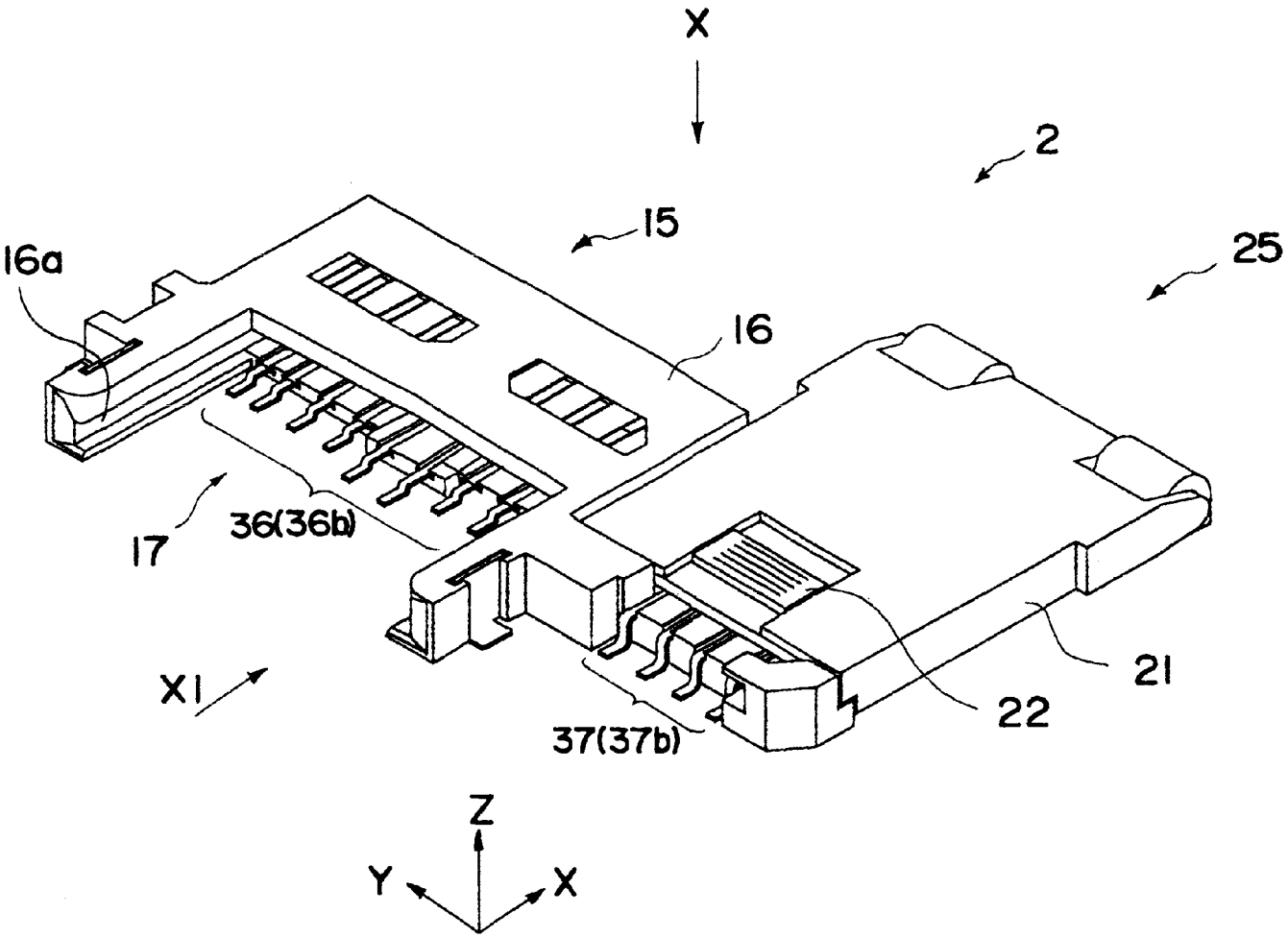
FIG. 9 is a perspective view of another card connector 2 as a preferred embodiment according to the present invention, in which view, a flap member located at the upper part of the connector is closed.
Figure 10:
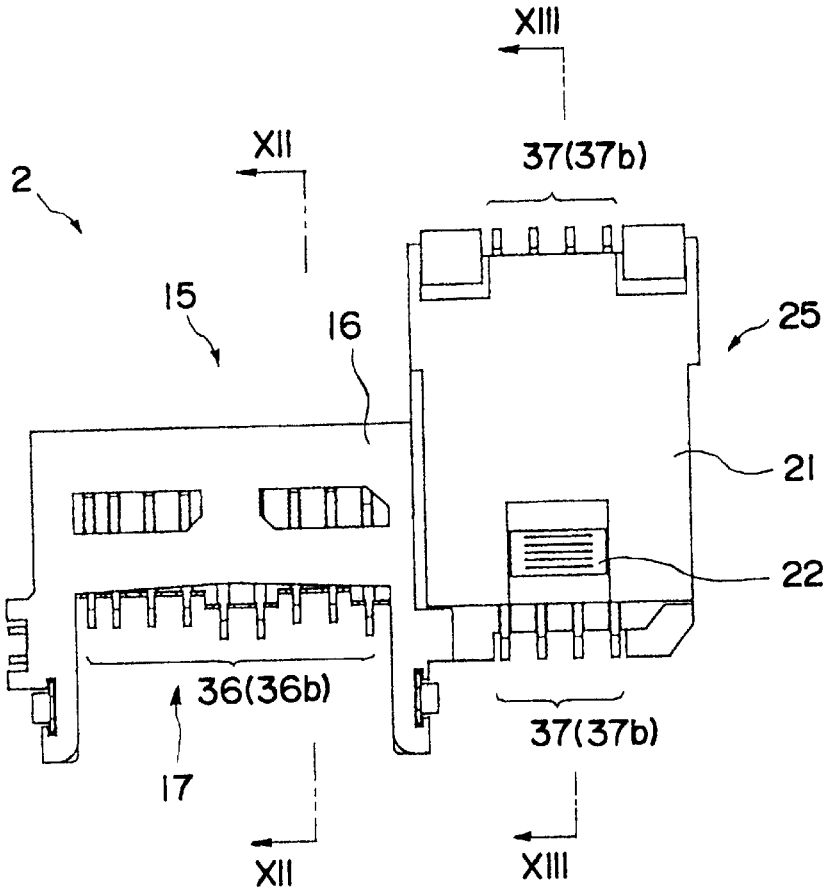
FIG. 10 is a plan view of the card connector 2, viewed in the direction indicated by arrow X in FIG. 9.
Figure 11:
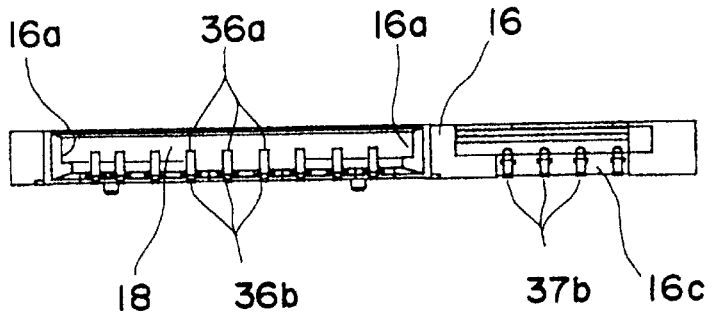
FIG. 11 is a front view of the card connector 2, viewed in the direction indicated by arrow XI in FIG. 9.
Figure 12:
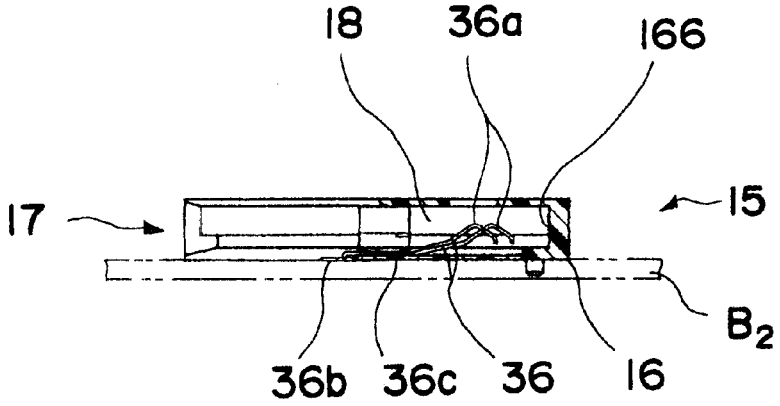
FIG. 12 is a sectional view of the card connector 2, taken along line XII—XII in FIG. 10.
Figure 13:
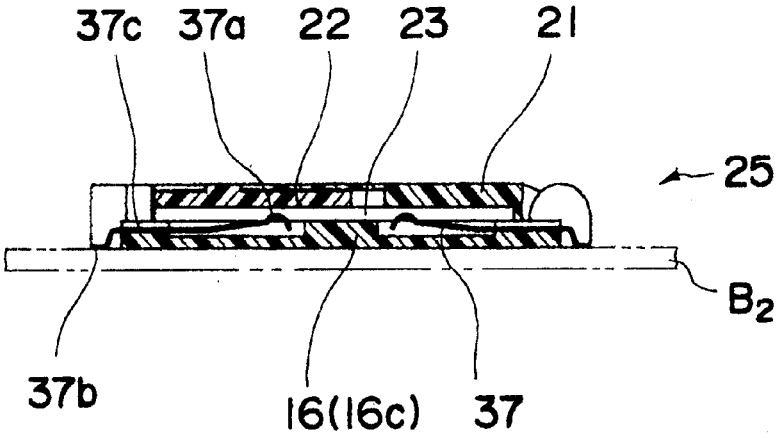
FIG. 13 is a sectional view of the card connector 2, taken along line XIII—XIII in FIG. 10.
Figure 14A:
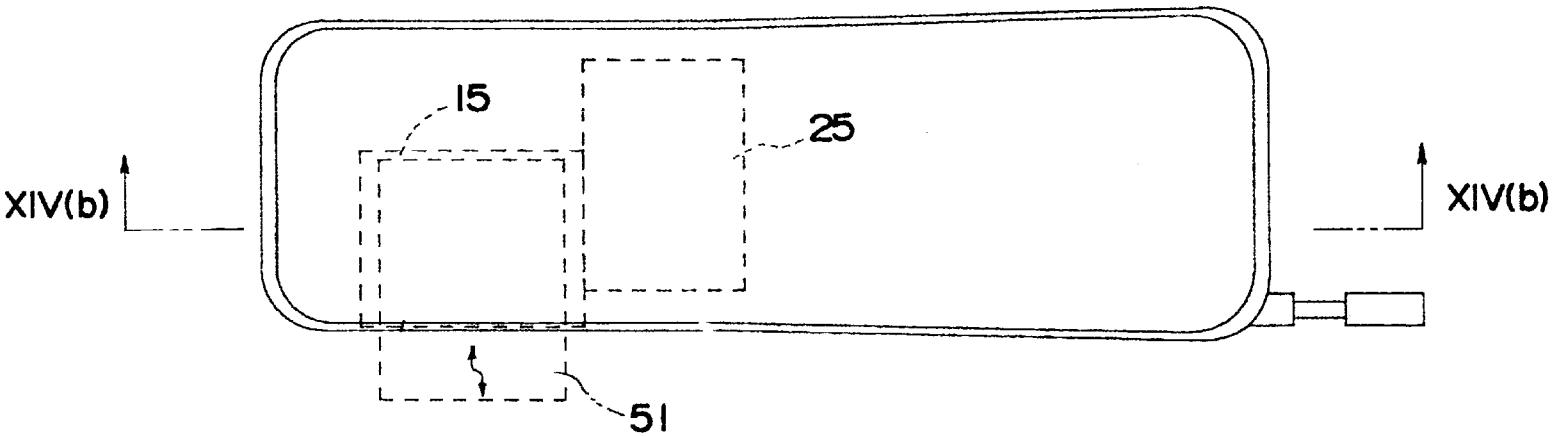
FIGS. 14(*a*) and 14(*b*) are an illustration showing the condition of the card connector 2 being mounted on a circuit board which is provided in a cellular phone.
Figure 14B:
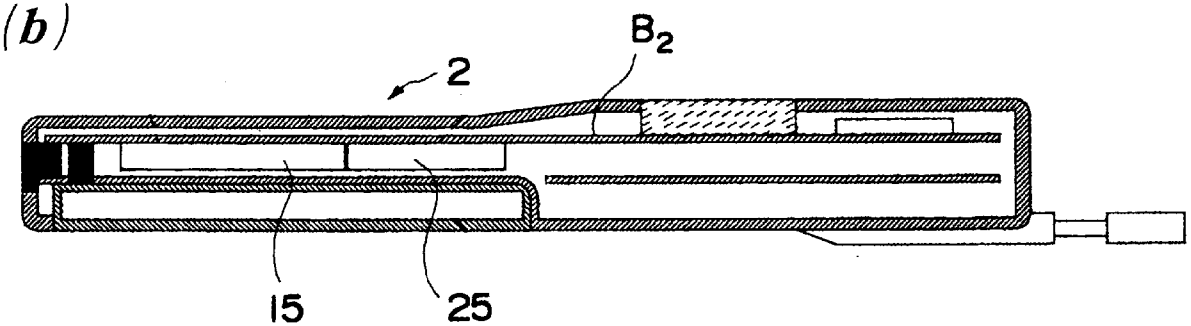

A perspective view of the card connector 2 is shown in FIG. 9, in which the directions along the X, Y and Z coordinate axes shown are referred to, in the following description, as "front and rear direction", "right and left direction" and "up and down direction" for ease of understanding. A plan view of the card connector 2 in the direction indicated by arrow X in FIG. 9 is shown in FIG. 10, a front view in the direction indicated by arrow XI in FIG. 9 is shown in FIG. 11, and a sectional view of the card connector 2, taken along line XII—XII in FIG. 10, is shown in FIG. 12 while a sectional view taken along line XIII—XIII in FIG. 10 is shown in FIG. 13. Additionally, FIG. 14 shows the card connector 2 being mounted on the printed circuit board B2, which is incorporated in a cellular phone.

The card connector 2 comprises a main body 16 as a common base for the first connector section 15 and the second connector section 25, a flap member 21, a plurality of first contacts 36 and a plurality of second contacts 37. The flap member 21 is provided pivotally on the main body 16 on a side of the first connector section 15, and it can be opened and closed. The first contacts 36 are aligned in the first connector section 15 and enables electrical connection for information transfer between the first card 51 and the circuit provided on the printed circuit board. The second contacts 37 are aligned in the second connector section 25 and enables electrical connection for information transfer between the second card 52 and the circuit of the circuit board. The main body 16, the flap member 21, the first contacts 36, the second contacts 37, etc. are made of the same materials and by the same processing techniques used for the counterparts of the card connector 1.

The main body 16 has a slot-like receiving part 18, which accommodates the first card 51, with an insertion opening 17 on the front thereof. The receiving part 18 has guide portions 16*a* at the right and left edges thereof to guide the right and left sides of the first card 51 and a wall portion 16*b* to be hit by the inserted end of the first card 51. The wall portion 16*b* stops the insertion of the first card 51 and fixes the relative position of the first card 51 in the receiving part 18, where the first contacts 36 are aligned.

Each first contact 36 is formed in a thin and long finger-like figure and bent in a plurality of steps, and it comprises a contact portion 36*a* at one end, which comes into contact with a corresponding terminal of the first card 51, a tail portion 36*b* at the other end, which is soldered to a corresponding terminal provided in the circuit of the circuit board, and a retained portion 36*c*, which is the part between the contact portion 36*a* and the tail portion 36*b* and is press-fit and fixed in the main body 16. The first contacts 36 are press-fit into slits which are provided at a predetermined pitch on the lower side of the main body 16 near the insertion opening 17, so that the retained portions 36*c* of the first contacts 36 are aligned parallel with one another toward the wall portion 16*b* and retained fixedly in the main body 16.

In this condition, the contact portions 36*a* of the first contacts 36 extend upward in the receiving part 18 of the main body 16. When the first card 51 is inserted into the receiving part 18, the first contacts 36 undergo an elastic deformation. As a result, a predetermined contact pressure is generated and kept between the contact portions 36*a* of the first contacts 36 and the corresponding terminals that are provided on the lower surface of the first card 51. The tail portions 36*b* of the first contacts 36 extending outward from the main body 16 are aligned parallel to and positioned a little lower than the lower surface of the main body 16. When the card connector 2 is assembled to the circuit board, the tail portions 36*b* are soldered to the corresponding terminals of the circuit provided on the circuit board.

When the first card 51 is inserted through the insertion opening 17 of the main body 16 in the first connector section 15, the terminals provided on the lower surface of the first card 51 come into contact with the contact portions 36*a* of the first contacts 36 in the receiving part 18 of the main body 16. In this condition, information transfer can be executed between the first card 51 and the circuit of the circuit board through the first contacts 36.

Laterally next to the first connector section 15, the second connector section 25 is arranged on a bottom portion 16*c* which is the common base of the main body 16 continuous from the first connector section 15, and the second contacts 37 are provided on the bottom portion 16*c*. In this case, the bottom portion 16*c* is a counterpart of the partition wall 11*c* described in the previous embodiment of card connector. As shown in the sectional view of FIG. 13, the second connector section 25 has, on the main body 16, a construction similar to that of the second connector section 20 of the card connector 1, which is described previously.

Each second contact 37 is also formed in a long finger-like figure and comprises a contact portion 37*a*, a tail portion 37*b* and a retained portion 37*c*. The contact portion 37*a* is located at one end of the second contact 37 and formed in an arc figure, and it comes into contact with a corresponding terminal provided on the second card 52. The tail portion 37*b* is located at the other end of the second contact 37, and it is soldered onto a corresponding terminal provided in the circuit of the circuit board. The retained portion 37*c* is the part between the contact portion 37*a* and the tail portion 37*b*, and it is press-fit and retained in the main body 16. The second contacts 37 are press-fit into slits provided at a predetermined pitch on the front and rear sides of the bottom portion 16*c* of the main body 16, so that the retained portions 37*c* are aligned and fixed in the main body 16. In this condition, the contact portions 37*a* of the second contacts 37 in a cantilever-like condition are positioned in window-like openings that are provided in the bottom portion 16*c*, with the contact portions 37*a* being raised above the upper surface of the bottom portion 16*c*.

Therefore, when the contact portions 37*a* are pressed downward, the second contacts 37 undergo an elastic deformation. The tail portions 37*b*, which extend outward from the main body 16, are arranged parallel to and a little lower than the lower surface of the main body 16. When the card connector 2 is mounted on the circuit board, the tail portions 37*b* are soldered to corresponding terminals provided in the circuit of the circuit board.

The flap member 21, which has the same construction as that of the previous embodiment, is mounted pivotally on the main body 16, so that the flap member 21 can be swung, i.e., opened and closed, in the X-Z coordinate system. The flap member 21 has a recess in the lower side thereof, so that when the flap member 21 is closed, a retaining space 23 is provided between the lower surface of the flap member 21 and the upper surface of the bottom portion 16*c*, as an accommodation for the second card 52. At the right and left sides of the retaining space 23 of the flap member 21, guide grooves 21*a* are provided to slide the sides of the second card 52. Furthermore, a slide lock 22, which can be engaged and disengaged to the main body 16, is provided at the upper part of the flap member 21.

Therefore, after the second card 52 is inserted along the guide grooves 21*a* into the flap member 21, when the flap member 21 is swung downward and closed, the second card 52 is accommodated in the retaining space 23, with the terminals of the second card 52 being in contact with the contact portions 37*a* of the second contacts 37. Then, while the flap member 21 is being pressed downward, the slide lock 22 is engaged to lock the flap member 21 to the main body 16. In this installed condition of the second card 52, a predetermined contact pressure is generated and kept between the contact portions 37*a* of the second contacts 37 and the terminals of the second card 52.

When the second card 52 is set in the retaining space 23 of the second connector section 25, which is arranged laterally next to the first connector section 15, the terminals of the second card 52, which are positioned on the lower surface thereof, are in contact with the contact portions 37*a* of the second contacts 37. In this condition, information transfer can be executed between the second card 52 and the circuit of the circuit board through the second contacts 37. Because the first connector section 15 and the second connector section 25 are arranged laterally next to each other, the card connector 2, which allows the installation of these two cards, is formed evenly with a uniform height. Also, because the card connector 2 incorporates two connector units in a one-piece body, not only the cost for manufacturing the card connector but also the cost for managing the parts and the number of the assembly steps required for the production of the card connector can be kept to a relatively small level. As a result, by incorporating the card connector 2, it is possible to produce, at a relatively low cost, multi-functional electronics products such as cellular phones and information processing devices in thin and light-weight bodies.

In the above embodiments, the present invention is embodied as surface-mount type card connectors, i.e., the card connectors 1 and 2, which are surface-mounted on a printed circuit board. However, the tail portions of the first contacts and the second contacts may be modified to make the card connectors applicable to a through-hole circuit board. In the preferred embodiments, the first card and the second card are described as a SD Card and a SIM Card (both are registered trademarks), respectively. However, the types of memory cards to be used in a card connector according to the present invention are not limited to these types, so other types of memory cards can be also used with the card connector of the present invention.

As described above, according to a feature of the present invention, a card connector comprises a first connector section and a second connector section, which are constructed with a main body, a flap member, a plurality of first contacts and a plurality of second contacts. The first connector section allows insertion and removal of a first card-like memory module for electrical connection through the first contacts, which are provided in a receiving part at the lower part of the main body. The second connector section allows installation and removal of a second card-like memory module for electrical connection through the second contacts, which are provided on the main body above the receiving part, with the flap member being arranged on the main body pivotally to be opened and closed for installation of the second card-like memory module. This construction of the card connector makes it possible that the installation area required for one card connector be used effectively by an integrated card connector which allows simultaneous use of two card-like memory modules. This arrangement is advantageous for reducing the number of parts as well as the number of assembly steps required for production. Therefore, such card connectors and printed circuit boards on which the card connectors are to be installed can be mass produced at a relatively low cost.

According to another feature of the present invention, a card connector comprises a first connector section and a second connector section, which are constructed with a main body, a flap member, a plurality of first contacts and a plurality of second contacts. The first connector section allows insertion and removal of a first card-like memory module for electrical connection through the first contacts, which are aligned in a receiving part provided in the main body. The second connector section allows installation and removal of a second card-like memory module for electrical connection through the second contacts, which are provided on the part of the main body extending laterally away from the receiving part of the first connector section, with the flap member being arranged pivotally on the laterally extended part of the main body, so that the flap member can be opened and closed for installation of the second card-like memory module. This construction allows the card connector, which enables simultaneous use of two removable card-like memory modules, to have a uniform height over the two connector sections. This arrangement is also advantageous for reducing the number of parts as well as the number of assembly steps required for production. Therefore, such card connectors and printed circuit boards on which the card connectors are to be installed can be mass produced at a relatively low cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A card connector comprising a first connector section and a second connector section in a one-piece body, wherein said first connector section is to removably accommodate a first card-like memory module and said second connector section is to accommodate a second card-like memory module in a closed flap member, said flap member being pivotable between an opened position and a closed position wherein:

said first connector section comprises:

a main body having a receiving part, where said first card-like memory module is inserted and removed through an insertion opening provided on a side of said main body; and a plurality of first contacts, each contact, which is retained in said main body, comprising a first contact portion at one end, which extends out of a lower surface of said receiving part into said receiving part, and a first mounting portion at another end, which extends to and comes out of a lower surface of said main body; whereby:

when said first card-like memory module is inserted into said receiving part, terminals provided on said first card-like memory module come into contact with said first contact portions, so that information transfer can be executed between first card-like memory module and a plated printed circuit provided on a circuit board, to which said first mounting portions are connected; and said second connector section comprises:

said flap member, which is mounted on upper part of said main body pivotally so as to be opened and closed with respect to said main body and which engages and retains said second first card-like memory module in said closed position, keeping said second card-like memory module parallel to an upper surface of said main body and above said receiving part; and a plurality of second contacts, each contact, which is retained in said main body, comprising a second contact portion at one end, which extends upward out of said main body at a location above said receiving part, and a second mounting portion at another end which extends to and comes out of said lower surface of said main body; whereby:

when said flap member is closed to install said second card-like memory module on an upper part of said main body, terminals provided on said second card-like memory module come into contact with said second contact portions, so that information transfer can be executed between said second card-like memory module and a plated printed circuit provided on a circuit board, to which said second mounting portions are connected.

2. The card connector as set forth in claim 1, wherein said first mounting portions of said first contacts and said second mounting portions of said second contacts are arranged on sides of said main body which sides are faced in two directions that meet at right angles.

3. The card connector as set forth in claim 2, wherein:

said receiving part, which has a slot-like figure and accommodates said first card-like memory module, is located inside said insertion opening of said main body;

guide portions, which are to guide right and left sides of said first card-like memory module, are formed on right and left sides of said receiving part;

a wall portion, which comes into contact with an inserted end of said first card-like memory module and stops said first card-like memory module being inserted into said receiving part, is provided at innermost part of said receiving part; and said first contacts are press-fit from outside of said main body into said wall portion of said main body and retained therein fixedly.

4. The card connector as set forth in claim 3, wherein:

each of said first contacts is formed in a thin and long finger-like figure and bent in a plurality of steps, each first contact comprising said first contact portion at one end, which comes into contact with a corresponding terminal of said first card-like memory module, said first mounting portion at another end, which is soldered to a terminal provided in said circuit, and a retained portion which is part between said first contact portion and said first mounting portion;

when said first card-like memory module is inserted into said receiving part, said first contact portions, which extend upward in said receiving part, undergo elastic deformation and come into contact with said terminals provided on a lower surface of said first card-like memory module; and said first mounting portions, which extend outward from said main body, are retained parallel to and a little lower than said lower surface of said main body, so that said first mounting portions are soldered to corresponding terminals provided in said circuit.

5. The card connector as set forth in claim 2, wherein:

a partition wall, which partitions said receiving part, is provided as said upper surface of said main body, so that said second contacts are arranged on said partition wall; and each of said second contacts is formed in a thin and long finger-like figure, each second contact comprising said second contact portion at one end thereof, which is formed in an arc figure and to come into contact with a corresponding terminal provided on said second card-like memory module, said second mounting portion at another end, which is to be soldered onto a corresponding terminal provided in said circuit, and a retained portion which is part between said second contact portion and said second mounting portion and to be press-fit and retained in said main body.

6. The card connector as set forth in claim 5, wherein:

when said second card-like memory module, which is set in said flap member, is turned downward by the flap member being closed, said second contact portions, which are supported upward in a cantilever-like condition by said retained portions of said second contacts press-fit and retained in said main body, come into contact with and are pressed downward by said terminals of said second card-like memory module; and said second mounting portions, which extend outward from said main body, are retained parallel to and a little lower than said lower surface of said main body, so that said second mounting portions are soldered to corresponding terminals provided in said circuit.

7. A card connector comprising a first connector section and a second connector section in a one-piece body, wherein said first connector section is to removably accommodate a first card-like memory module and said second connector section is to accommodate a second card-like memory module in a closed flap member, said flap member being pivotable between an opened position and a closed position wherein:

said first connector section comprises:

a main body having a receiving part with an insertion opening, which receiving part, said first card-like memory module is inserted and removed from through said insertion opening; and a plurality of first contacts, each contact, which is retained in said main body, comprising a first contact portion at one end, which extends out of a lower surface of said receiving part into said receiving part, and a first mounting portion at another end, which extends to and comes out of a lower surface of said main body; whereby:

when said first card-like memory module is inserted into said receiving part, terminals provided on said first card-like memory module come into contact with said first contact portions, so that information transfer can be executed between first card-like memory module and a plated printed circuit provided on a circuit board, to which said first mounting portions are connected; and said second connector section comprises:

said flap member, which is mounted pivotally on upper part of said main body that extends laterally away from said receiving part, said flap member capable of being opened and closed with respect to said main body so as to engage and retain said second first card-like memory module in said closed position, keeping said second card-like memory module laterally next to said first card-like memory module installed in said receiving part; and a plurality of second contacts, each contact, which is retained in said main body, comprising a second contact portion at one end, which extends upward out of said part of said main body that extends laterally away from said receiving part, and a second mounting portion at another end which extends to and comes out of said lower surface of said main body; whereby:

when said flap member is closed to install said second card-like memory module, terminals provided on said second card-like memory module come into contact with said second contact portions, so that information transfer can be executed between said second card-like memory module and a plated printed circuit provided on a circuit board, to which said second mounting portions are connected.

* * * * *